US008603266B2

(12) United States Patent
Gong et al.

(10) Patent No.: US 8,603,266 B2
(45) Date of Patent: Dec. 10, 2013

(54) AMORPHOUS ALLOYS HAVING ZIRCONIUM AND METHODS THEREOF

(75) Inventors: Qing Gong, Shenzhen (CN); Yunchun Li, Shenzhen (CN); Yongxi Jian, Shenzhen (CN); Faliang Zhang, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 363 days.

(21) Appl. No.: 12/941,416

(22) Filed: Nov. 8, 2010

(65) Prior Publication Data

US 2011/0280761 A1 Nov. 17, 2011

(30) Foreign Application Priority Data

Nov. 11, 2009 (CN) ..... 200910221643
Dec. 28, 2009 (CN) ..... 200910254397

(51) Int. Cl.
*C22B 9/04* (2006.01)
*C22C 45/10* (2006.01)

(52) U.S. Cl.
USPC ..... 148/538; 148/561; 164/57.1; 164/61

(58) Field of Classification Search
None
See application file for complete search history.

(56) References Cited

U.S. PATENT DOCUMENTS 4,363,658 A * 12/1982 Shushlebin et al. ..... 420/581
4,913,879 A * 4/1990 Honda et al. ..... 420/434
5,288,344 A 2/1994 Peker et al.
5,368,659 A 11/1994 Peker et al.
5,797,443 A 8/1998 Lin et al.
6,374,899 B1 4/2002 Yamaguchi et al.
6,562,156 B2 5/2003 Liu
6,682,611 B2 1/2004 Zhang et al.
6,709,536 B1 3/2004 Kim et al.
6,805,758 B2 10/2004 Wolter
6,896,750 B2 5/2005 Wolter
7,008,490 B2 3/2006 Peker
7,153,376 B2 12/2006 Wolter
7,244,321 B2 7/2007 Kim et al.
7,357,731 B2 4/2008 Johnson et al.
2003/0075246 A1 4/2003 Peker
2003/0150294 A1* 8/2003 Stefansson et al. ..... 75/407

(Continued)

FOREIGN PATENT DOCUMENTS

CN 1548572 A 11/2004
EP 2103699 A1 9/2009

(Continued)

OTHER PUBLICATIONS

He Lin et al., Effect of Oxygen on the Thermal Stability of Zr—Cu—Ni—Al—Ti Bulk Amorphous Alloy; Feb. 2006; vol. 42, No. 2; pp. 134-138; ACTA Metallurgica Sinica.

(Continued)

*Primary Examiner* — George Wyszomierski
(74) *Attorney, Agent, or Firm* — Greenberg Traurig, LLP

(57) ABSTRACT

Alloys and methods of preparing the same are provided. The alloys are represented by the general formula of $(Zr_aM_bN_c)_{100-x}Q_x$, in which M is at least one transition metal except Zr; N is Be or Al; Q is selected from the group consisting of CaO, MgO, $Y_2O_3$, $Nd_2O_3$, and combinations thereof; a, b, and c are atomic percents of corresponding elements; and $45 \le a \le 75$, $20 \le b \le 40$, $1 \le c \le 25$, $a+b+c=100$, and $1 \le x \le 15$. A method of recycling a Zr-based amorphous alloy waste is also provided.

17 Claims, 2 Drawing Sheets

(56) References Cited

U.S. PATENT DOCUMENTS

| | | | |
|---|---|---|---|
| 2003/0217790 | A1 | 11/2003 | Wolter |
| 2004/0084114 | A1 | 5/2004 | Wolter |
| 2004/0216812 | A1 | 11/2004 | Wolter |
| 2006/0108033 | A1 | 5/2006 | Peker et al. |
| 2006/0154745 | A1 | 7/2006 | Johnson et al. |
| 2007/0107810 | A1 | 5/2007 | Farmer |
| 2007/0131312 | A1 | 6/2007 | Kim et al. |
| 2008/0190521 | A1 | 8/2008 | Loffler et al. |
| 2009/0139612 | A1 | 6/2009 | Lu et al. |
| 2011/0094633 | A1 | 4/2011 | Gong et al. |
| 2011/0097237 | A1 | 4/2011 | Gong et al. |
| 2011/0308671 | A1 | 12/2011 | Gong et al. |
| 2012/0067466 | A1 | 3/2012 | Gong et al. |
| 2012/0073706 | A1 | 3/2012 | Gong et al. |
| 2012/0073707 | A1 | 3/2012 | Gong et al. |
| 2012/0073709 | A1 | 3/2012 | Gong et al. |

FOREIGN PATENT DOCUMENTS

| | | | |
|---|---|---|---|
| JP | 2000234156 | A | 8/2000 |
| WO | WO 2010130199 | A1 | 11/2010 |
| WO | WO 2011050695 | A1 | 5/2011 |

OTHER PUBLICATIONS

Patent Abstracts of Japan; Abstract for Japanese Publication No. 2000-234156; Downloaded from www.19.ipd.linpit.go.jp/PA1/result/detail/main/wj6liyaDA412234156P1.htm; Aug. 29, 2000; One page; Japan.

Jiang, F. et al.; "Formation of Zr-Based Bulk Metallic Glasses from Low Purity Materials by Scandium Addition;" Scripta Materialla, vol. 53, pp. 487-491; Jun. 2005.

Patent Cooperation Treaty; International Search Report Issued in Connection with International Application No. PCT/CN2010/072643; Aug. 12, 2010; 2 pages; China.

Patent Cooperation Treaty; PCT Written Opinion of the International Searching Authority; Issued in Connection with International Application No. PCT/CN2010/072643; Aug. 12, 2010; 3 pages; China.

Patent Cooperation Treaty; International Search Report Issued in Connection with International Application No. PCT/CN2010/078014; Jan. 27, 2011; 5 pages; China.

Patent Cooperation Treaty; PCT Written Opinion of the International Searching Authority; Issued in Connection with International Application No. PCT/CN2010/078014; Jan. 27, 2011; 6 pages; China.

U.S. Patent and Trademark Office; Non-Final Office Action Issued Against U.S. Appl. No. 12/890,063; Jan. 26, 2012; 9 pages; U.S.A.

U.S. Patent and Trademark Office; Non-Final Office Action Issued Against U.S. Appl. No. 13/310,128; Jan. 30, 2012; 9 pages; U.S.A.

U.S. Patent and Trademark Office; Non-Final Office Action Issued Against U.S. Appl. No. 12/904,497; Feb. 6, 2012; 13 pages; U.S.A.

U.S. Patent and Trademark Office; Non-Final Office Action Issued Against U.S. Appl. No. 13/148,725; Mar. 1, 2012; 9 pages; U.S.A.

U.S. Patent and Trademark Office; Non-Final Office Action Issued Against U.S. Appl. No. 13/310,018; Mar. 5, 2012; 8 pages; U.S.A.

Faliang Zhang; "Declaration Under 37 C.F.R § 1.132 of Faliang Zhang;" Jun. 4, 2012; 27 pages; U.S.A.

* cited by examiner

AMORPHOUS ALLOYS HAVING ZIRCONIUM AND METHODS THEREOF

CROSS-REFERENCE TO RELATED APPLICATIONS

This application claims the priority and benefit of the Chinese Patent Application No. 200910221643.8 filed with State Intellectual Property Office, P. R. C. on Nov. 11, 2009, and Chinese Patent Application No. 200910254397.6 filed with State Intellectual Property Office, P. R. C. on Dec. 28, 2009.

FIELD OF DISCLOSURE

The present disclosure relates generally to amorphous alloys, and methods for preparing the same. More particularly, the present disclosure relates to amorphous alloys having zirconium, and methods for preparing and recycling the same.

BACKGROUND

Amorphous metallic alloys may have a generally disordered atomic-scale structure, which is in contrast to most metals that are often crystalline and have a generally organized atomic-scale structure. Amorphous metallic alloys may otherwise be referred to as "metallic glasses" or "glassy metals." Such alloys may be used in connection with a wide variety of applications, including, without limitation, in connection with golf clubs, industrial coatings and overlays, and cellular telephone technology.

SUMMARY

In accordance with various illustrative embodiments hereinafter disclosed are alloys, which may be represented by the general formula of $(Zr_aM_bN_c)_{100-x}Q_x$, wherein M is at least one transition metal of the periodic table of the elements other than Zr; N is Be or Al; and Q is selected from the group consisting of CaO, MgO, $Y_2O_3$, $Nd_2O_3$, and combinations thereof, a, b, and c are atomic percents of corresponding elements, and $45 \le a \le 75$, $20 \le b \le 40$, $1 \le c \le 25$, $a+b+c=100$, and $1 \le x \le 15$.

In accordance with further illustrative embodiments hereinafter disclosed are methods of preparing alloys. The method may include mixing raw materials comprising Zr, M, N and Q according to a molar ratio of $Zr_a M_b N_c$:Q:Zr of about (100–x):(x+y):y to form a first mixture, wherein M is at least one transition metal of the periodic table of the elements other than Zr; N is Be or Al; Q is selected from the group consisting of CaO, MgO, $Y_2O_3$, $Nd_2O_3$, and combinations thereof; a, b, and c are atomic percents of corresponding elements; and $45 \le a \le 75$, $20 \le b \le 40$, $1 \le c \le 25$, $a+b+c=100$, $1 \le x \le 15$, and $0.1 \le y \le 5$. The first mixture may be melted to form a molten mixture. The molten mixture may be filtered, cast, and cooled to an alloy represented by the general formula of $(Zr_aM_bN_c)_{100-x}Q_x$, wherein M is at least one transition metal of the periodic table of the elements other than Zr; N is Be or Al; Q is selected from the group consisting of CaO, MgO, $Y_2O_3$, $Nd_2O_3$, and combinations thereof; a, b, and c are atomic percents of corresponding elements; and $45 \le a \le 75$, $20 \le b \le 40$, $1 \le c \le 25$, $a+b+c=100$, $1 \le x \le 15$, and $0.1 \le y \le 5$.

In accordance with further illustrative embodiments hereinafter disclosed are methods of recycling alloys. The method may include mixing a waste alloy waste with an additive to form a mixture, wherein the additive may be a mixture of Zr and a metal oxide selected from the group consisting of CaO, MgO, $Y_2O_3$, $Nd_2O_3$, and combinations thereof. The mixture may be melted, preferably under a vacuum, to form a molten mixture. The molten mixture may be filtered, cast, and cooled, under an inert gas, to form a regenerated alloy. The regenerated alloy may be represented by the general formula of $(Zr_aM_bN_c)_{100-x}Q_x$, wherein M is at least one transition metal of the periodic table of the elements other than Zr; N is Be or Al; and Q is selected from the group consisting of CaO, MgO, $Y_2O_3$, $Nd_2O_3$, and combinations thereof, a, b, and c are atomic percents of corresponding elements, and $45 \le a \le 75$, $20 \le b \le 40$, $1 \le c \le 25$, $a+b+c=100$, and $1 \le x \le 15$.

While alloys of the present disclosure, such as amorphous alloys, and methods thereof, will be described in connection with various preferred illustrative embodiments, it will be understood that this disclosure is not intended to limit the alloys and methods thereof to those embodiments. On the contrary, this disclosure is intended to cover all alternatives, modifications, and equivalents as may be included within the spirit and scope of the alloys and methods as defined by the appended claims. Further, in the interest of clarification and without limitation, the numerical ranges provided herein are intended to be inclusive of all alternative ranges. As a non-limiting example, where a ratio of "about 1:about 0.1 to about 5" is provided, it is intended to disclose all intermediate ratios, including 1:0.11, 1:0.25, 1:1.3, 1:4.95, etc.

BRIEF DESCRIPTION OF THE DRAWINGS

These and other aspects and advantages of the present disclosure will become apparent and more readily appreciated from the following descriptions taken in conjunction with the drawing figures in which.

DETAILED DESCRIPTION OF THE EMBODIMENTS

Figure 1:
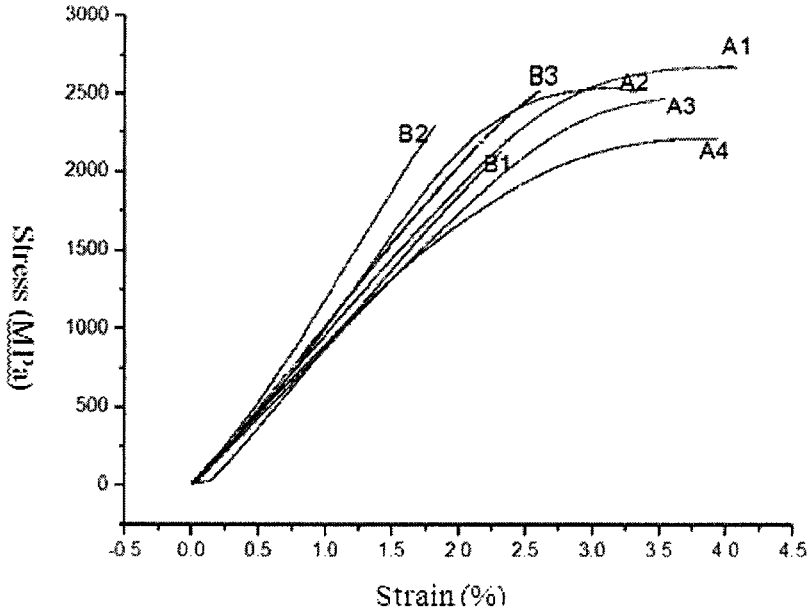
FIG. 1 illustrates a stress-strain diagram of exemplary and comparative alloys of the present disclosure.

Reference will be made in detail to embodiments of the present disclosure. The embodiments described herein are explanatory, illustrative, and used to generally understand the present disclosure. The embodiments shall not be construed to limit the present disclosure.

The Periodic Table of Elements referred to herein is the IUPAC version of the periodic table of elements described in the *CRC Handbook of Chemistry and Physics,* 90$^{th}$ Edition, CRC Press, Boca Raton, Fla. (2009-2010).

Composition of Alloys

According to an aspect of the present disclosure, an alloy represented by a general formula of $(Zr_aM_bN_c)_{100-x}Q_x$ may be provided, wherein M is at least one transition metal of the periodic table of the elements other than Zr; N is Be or Al; and Q is selected from the group consisting of CaO, MgO, $Y_2O_3$, $Nd_2O_3$, and combinations thereof, a, b, and c are atomic percents of corresponding elements, and $45 \le a \le 75$, $20 \le b \le 40$, $1 \le c \le 25$, $a+b+c=100$, and $1 \le x \le 15$.

In an alternative embodiment and without wishing to be bound by theory, applicant believes that the alloy's toughness may be relatively improved wherein: $50 \le a \le 70$, $25 \le b \le 35$, $3 \le c \le 23$, and $2 \le x \le 5$. In an alternative embodiment and without wishing to be bound by the theory, applicant believes that the alloy's toughness and glass formability may be relatively improved wherein: M is two or more metals selected from the group consisting of: Ti, Ni and Cu. In a further alternative embodiment, M may be the combination of Ni and Cu with an atom ratio of about 1:10 to about 1:3.5, or the combination of Ni, Cu and Ti with an atom ratio for Ni:Cu:Ti of about 1:(1-2):(1.2-2.5).

According to embodiments of the present disclosure, the alloy may have a bending strength of at least about 2500 MPa, alternatively between about 2500 MPa and 2800 MPA. In various embodiments, the alloy of the present disclosure may have a maximum plastic strain of at least about 3%, alternatively between about 3% and about 4.5%. In various embodiments, the alloy of the present disclosure may have an impact toughness of at least about 90 $KJ/m^2$, alternatively between about 90 $KJ/m^2$ and 110 $KJ/m^2$.

In various embodiments, the alloys described herein may be described as amorphous alloy(s). For the purposes of this disclosure, an "amorphous alloy" may mean a metallic alloy having a non-crystalline disordered atomic-scale structure. In an embodiment, the alloys of the present disclosure may have a crystalline phase with a volume percent of about 12%, based on the total volume of the alloy.

Methods of Preparing Alloys

According to another aspect of the present disclosure, a method for preparing an alloy may be provided. The method may include mixing raw materials comprising Zr, M, N and Q according to a molar ratio of $Zr_a M_b N_c$:Q:Zr of about (100−x):(x+y):y to form a first mixture, wherein M is at least one transition metal of the periodic table of the elements other than Zr; N is Be or Al; Q is selected from the group consisting of CaO, MgO, $Y_2O_3$, $Nd_2O_3$, and combinations thereof; a, b, and c are atomic percents of corresponding elements; and $45 \le a \le 75$, $20 \le b \le 40$, $1 \le c \le 25$, $a+b+c=100$, $1 \le x \le 15$, and $0.1 \le y \le 5$. The first mixture may be melted to form a molten mixture. The molten mixture may be filtered, cast, and cooled to an alloy represented by the general formula of $(Zr_aM_bN_c)_{100-x}Q_x$, wherein M is at least one transition metal of the periodic table of the elements other than Zr; N is Be or Al; Q is selected from the group consisting of CaO, MgO, $Y_2O_3$, $Nd_2O_3$, and combinations thereof; a, b, and c are atomic percents of corresponding elements; and $45 \le a \le 75$, $20 \le b \le 40$, $1 \le c \le 25$, $a+b+c=100$, $1 \le x \le 15$, and $0.1 \le y \le 55$.

According to an embodiment of the present disclosure, the molar ratio of $Zr_aM_bN_c$:Q:Zr may be about (100−x):(x+y):y. In an embodiment, Q having a molar percent of x/(100+2y) may be added to the raw materials. In an embodiment, Q having a molar percent of y/(100+2y) (i.e. relatively excess Q) may react with the $ZrO_2$ formed during preparation of the alloy, if any, to form a refractory composite oxide, which may be removed by subsequent filtering. Further, Zr having a molar percent of y/(100+2y) may compensate the Zr element lost during the reaction of Q and $ZrO_2$. In this embodiment, y may be determined by the moles of $ZrO_2$ formed during preparation of the alloy represented by the formula of $Zr_aM_bN_c$, in which M is at least one transition metal; N is Be or Al; and a, b, and c are atomic percents, in which $45 \le a \le 75$, $20 \le b \le 40$, $1 \le c \le 25$, and $a+b+c=100$. The moles of $ZrO_2$ formed during preparation of alloy may be obtained by testing the oxygen content of the alloy. In an embodiment, the oxygen content may be tested by an IRO-II oxygen content analyzer. In an embodiment, the raw material may have Zr, M, N and Q according to a molar ratio for $Zr_aM_bN_c$:Q: Zr of about (100−x):(x+y):y, and $1 \le x \le 15$, $0.1 \le y \le 5$; alternatively According to an embodiment of the present disclosure, the raw materials may be melted to form a molten mixture. The melting step may be performed in any suitable housing, including without limitation in a melting furnace having a melting chamber. In an alternative embodiment, the melting chamber may be vacuumized to a vacuum degree of about 0.1 Pa to about 10 Pa at a temperature of about 100° C. above the melting temperature of the alloy. An inert gas may then be introduced into the melting chamber, preferably filling the melting chamber, until the vacuum degree reaches about 30 kPa to about 50 kPa. In an further alternative embodiment, the melting chamber may be vacuumized to a vacuum degree of from about 0.5 Pa to about 5 Pa at a temperature of about 100° C. to about 300° C. above the melting temperature of the alloy. An inert gas may then be introduced into the melting chamber, preferably filling the melting chamber, until a vacuum degree of from about 35 kPa to about 45 kPa. The inert gas may be selected from group consisting of helium, nitrogen, argon, krypton, xenon, radon, and combinations thereof. In an embodiment, the term "vacuum degree" refers to absolute pressure.

In an embodiment, after the melting step, the molten mixture may be allowed to stand for a time ranging from about 1 minute to about 5 minutes. Thereafter, the molten mixture may be filtered and cast. Without wishing to be bound by the theory, Applicant believes that allowing the molten mixture to stand for a time ranging from about 1 minute to about 5 minutes may cool the molten mixture to a temperature suitable for casting, and/or allow the suspension of molten slag onto the surface of the molten mixture, which may improve the ability to filter the molten slag from the molten mixture.

According to an embodiment of the present disclosure, the molten mixture may be filtered through a high temperature resistant mesh. In an embodiment, the high temperature resistant mesh may have a diameter ranging from about 0.5 millimeters to about 5 millimeters, alternatively about 0.8 millimeters to about 2 millimeters. In an embodiment, any suitable high temperature resistant mesh may utilized, including those made from steel wire mesh, ceramic mesh, Mo wire mesh, and fiber mesh, as well as any material, or materials, having melting temperatures above from about 750° C. to about 1500° C.

According to an embodiment of the present disclosure, the molten mixture may be cast, under any casting conditions, in any mold. In an embodiment of the present disclosure, the molten mixture may be cast at a temperature ranging from about 30° C. to about 80° C. above the melting temperature of the alloy, preferable under a casting inert gas. The casting inert gas may be selected from helium, nitrogen, argon, krypton, xenon, radon, and combinations thereof, preferably helium and/or argon.

According to an embodiment of the present disclosure, the cooling step may be performed under a cooling inert gas. In an embodiment of the present disclosure, the cooling inert gas may be selected from helium, nitrogen, argon, krypton, xenon, radon, and combinations thereof, preferably helium and/or argon. The cooling inert gas may be the same or different inert gas from the casting inert gas.

Without wishing to be bound by the theory, Applicant believes that by preparing the alloy according to an embodiment of the present disclosure, the metal oxide may be introduced in the alloy, which significantly improving the toughness of the alloy. Further without wishing to be bound by the theory, excess Zr and excess metal oxide may be added to the raw materials, and the excess metal oxide may react with any such $ZrO_2$ formed during preparing the alloy, to form a refractory composite oxide, which may be removed by the subsequent filtering step. At the same time, without wishing to be bound by the theory, the excess Zr may compensate the Zr element lost during the reaction of the metal oxide and $ZrO_2$; thus, the amount of $ZrO_2$ in the alloy may be reduced, and may avoid any expansion stress formed during the phase transition of $ZrO_2$ in the cooling step.

Methods of Recycling Alloys

According to a further aspect of the present disclosure, a method for recycling a waste alloy waste may be provided. In an embodiment, in this disclosure the term "waste alloy" means any scrap, or unqualified sample, of Zr-based amorphous alloy, including without limitation spent articles made from Zr-based amorphous alloys. In a further embodiment, in this disclosure the term "waste alloy" means any alloy represented by the general formula of $Zr_aM_bN_cY_d$, in which M is at least one transition metal selected from the period table of elements; N is Be or Al; and a, b, c and d are atomic percents of corresponding elements, in which $45 \le a \le 65$, $20 \le b \le 40$, $1 \le c \le 25$, and $0 \le d \le 5$, alternatively $50 \le a \le 64$, $25 \le b \le 35$, $3 \le c \le 23$, $0 \le d \le 1$. In a further alternative embodiment, d may be 0, and M may be Cu, Ni and/or at least one of other transition metal elements.

The method may include mixing the waste alloy waste with an additive to form a mixture, wherein the additive may be a mixture of Zr and an additive metal oxide selected from the group consisting of CaO, MgO, $Y_2O_3$, $Nd_2O_3$, and combinations thereof. The mixture may be melted, preferably under a vacuum, to form a molten mixture. The molten mixture may be filtered, cast, and cooled, under an inert gas, to form a regenerated alloy. The regenerated alloy may be represented by the general formula of $(Zr_aM_bN_c)_{100-x}Q_x$, wherein M is at least one transition metal of the periodic table of the elements other than Zr; N is Be or Al; and Q is selected from the group consisting of CaO, MgO, $Y_2O_3$, $Nd_2O_3$, and combinations thereof, a, b, and c are atomic percents of corresponding elements, and $45 \le a \le 75$, $20 \le b \le 40$, $1 \le c \le 25$, $a+b+c=100$, and $1 \le x \le 15$.

The additive may be present in any amount, and may itself include any ratio of Zr: additive metal oxide. In an embodiment, the amount of Zr and the additive metal oxide may be determined by the oxygen content of the waste alloy. In an embodiment, relative to 100 parts by weight of the waste alloy, the amount of Zr may be $W_1$ parts by weight, and the amount of the additive metal oxide may be $W_2$ parts by weight, in which $W_1=(0.5\text{-}12)\times A$, and $W_2=(0.5\text{-}7)\times A$, wherein A is the weight percent of oxygen in the waste alloy. In an alternative embodiment, $W_1=(5\text{-}7)\times A$, and $W_2=(3\text{-}4)\times A$. In a further alternative embodiment, the total amount of Zr and additive metal oxide may be $W_3$ parts by weight, relative to 100 parts by weight of the waste alloy, wherein $W_3=(8.5\text{-}11)\times A$. Generally, based on the weight of the waste alloy, the oxygen content of the waste alloy may be more than about 0.1 weight percent, or more than about 1000 parts per million, particularly about 0.1 wt % to about 0.5 wt %, that is to say, generally, A may be from about 0.1 to about 0.5. The oxygen content of the waste alloy may be tested by an IRO-II oxygen content analyzer.

According to an embodiment of the present disclosure, the waste alloy may be mixed with the additive. The mixed waste alloy and additive may be melted by any known method. In an embodiment, the waste alloy and additive may be melted under a vacuum degree ranging from about 0.05 Pa to about 5 Pa, at a temperature of from about 200° C. to about 500° C. above the melting temperature of the waste alloy, and for a time ranging from about 2 minutes to about 10 minutes. Alternatively, the waste alloy and additive may be melted under at a vacuum degree ranging from about 0.08 Pa to about 0.5 Pa, at a temperature ranging from about 250° C. to about 400° C. above the melting temperature of the waste alloy, and from a time ranging from about 2 minutes to about 10 minutes, alternatively from about 4 minutes to about 10 minutes. In an embodiment, the term "vacuum degree" refers to absolute pressure.

In an embodiment, after the melting step, the molten mixture may be allowed to stand for a time ranging from about 1 minute to about 10 minutes. Thereafter, the molten mixture may be filtered and cast. Without wishing to be bound by the theory, Applicant believes that allowing the molten mixture to stand for a time ranging from about 1 minute to about 5 minutes may cool the molten mixture to a temperature suitable for casting, and/or allow the suspension of molten slag onto the surface of the molten mixture, which may improve the ability to filter the molten slag from the molten mixture. Without wishing to be bound by the theory, Applicant believes that a composite oxide of ZrO and additive metal oxide may have been formed where the molten slag contains a greater concentration of Zr, metal elements in the additive metal oxides, and oxygen than does the molten mixture.

According to an embodiment of the present disclosure, the molten mixture may be filtered through a high temperature resistant mesh. In an embodiment, the high temperature resistant mesh may have a diameter ranging from about 0.5 millimeters to about 10 millimeters, alternatively about 1 millimeter to about 6 millimeters. In an embodiment, any suitable high temperature resistant mesh may utilized, including those made from steel wire mesh, ceramic mesh, Mo wire mesh, and fiber mesh, as well as any material, or materials, having melting temperatures above from about 750° C. to about 1500° C.

Figure 3:
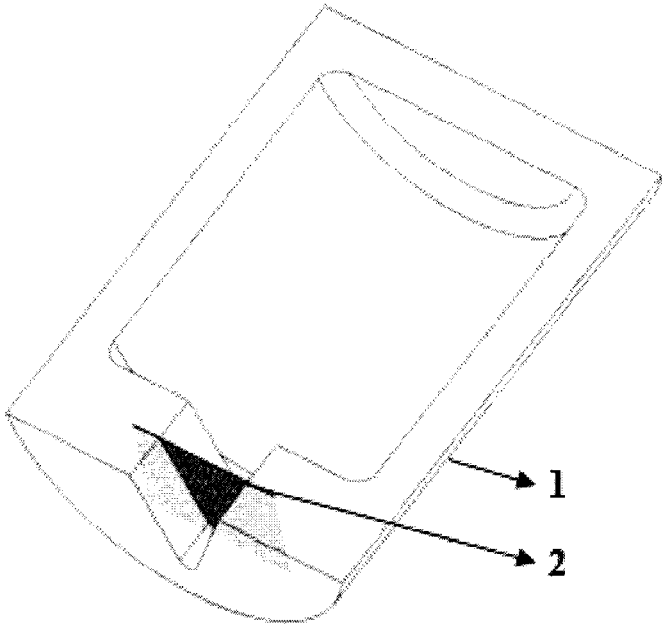
FIG. 3 illustrates a schematic of a pouring cup for recycling a waste alloy according to an embodiment of the present disclosure.

In an embodiment and with reference to FIG. 3, a pouring cup 1, having a high temperature resistant mesh 2 disposed at its outlet 3, may be used to filter the molten mixture (not shown).

In an embodiment, the filtered molten metal may be poured from the pouring cup 1 into a mold (not shown) to be cast. According to an embodiment of the present disclosure, the molten mixture may be cast, under any casting conditions, in any mold. The casting step may be performed at a temperature ranging from about 50° C. to about 150° C. above the melting temperature of the alloy, alternatively from about 80° C. to about 120° C. above the melting temperature of the alloy, and preferably under a casting inert gas. The casting inert gas may be selected from helium, nitrogen, argon, krypton, xenon, radon, and combinations thereof, preferably helium and/or argon.

According to an embodiment of the present disclosure, the cooling step may be performed under a cooling inert gas. In an embodiment of the present disclosure, the cooling inert gas may be selected from helium, nitrogen, argon, krypton, xenon, radon, and combinations thereof, preferably helium and/or argon. The cooling inert gas may be the same or different inert gas from the casting inert gas.

In an embodiment, the Zr-based amorphous alloy waste may be pretreated prior to the mixing step. The pretreatment step may be that known in the art, for example, the crushing treatment, the de-rusting treatment, the surface oxide removing treatment, and the degreasing treatment.

Without wishing to be bound by the theory, Applicant believes that Zr has a relatively high binding energy with element oxygen in the waste alloy, such that there is little free oxygen in the waste alloy; thus, it is relatively difficult to remove the oxygen in the waste alloy by adding rare earth elements, or other oxophilic elements into the waste alloy. Further without wishing to be bound by the theory, Applicant believes that if excess Zr and excess metal oxide are added to the waste alloy, the excess metal oxide may react with any $ZrO_2$ formed during recycling the alloy, to form a refractory composite oxide, such as $Y_2(ZrO_3)_3$, having a free energy of about −3887153 J/mol, which may be removed by the subsequent filtering step. At the same time, without wishing to be bound by the theory, the excess Zr may compensate the Zr element lost during the reaction of the metal oxide and $ZrO_2$, thus adding the damaged element Zr. Additionally, without wishing to be bound by the theory, the presence of CaO, MgO, $Y_2O_3$ and/or $Nd_2O_3$ may prevent the low temperature phase transition and the volume expansion of $ZrO_2$, thus preventing the alloy from being, or becoming, fragile, which stabilizes the alloy's mechanical properties.

The present disclosure will be described in detail with reference to the following embodiments.

Example 1

A first exemplary alloy was prepared as follows:

a) Zr, Al, Cu, Ni, and $Y_2O_3$, according to a molar ratio of $Zr_{55}Al_{10}Cu_{30}Ni_5$:$Y_2O_3$:Zr of about 97:4:1, were mixed to form a first mixture, in which Al, Cu and Ni were all high purity metals, Zr was zirconium sponge commercially available from Baoti Huashen Titanium Industry Co., Ltd., located in Jinzhou, P.R.C., and $Y_2O_3$ was a metal oxide. The first mixture was added to a melting chamber with a nominal capacity of about 25 Kg in a ZG-03 medium frequency vacuum induction melting furnace commercially available from Sante Vacuum Metallurgy Technology Industry Co., Ltd., located Jinzhou, P.R.C. The melting chamber was vacuumized to a vacuum degree of about 3 Pa, and then argon was filled in the melting chamber until the vacuum degree reached about 40 kPa. The first mixture was completely melted at a power of about 25 kW to form a molten mixture.

b) The molten mixture was kept at a temperature of about 950° C. (about 100° C. above the melting temperature of the alloy) for about 5 minutes, then was allowed to stand at room temperature for about 3 minutes.

c) When the temperature of the molten mixture dropped to about 920° C. (about 70° C. above the melting temperature of the alloy), the molten mixture was filtered by a pouring cup having a Mo wire mesh with a diameter of about 0.8 millimeters, cast in a mold, then cooled to room temperature under argon to form a first alloy ingot ("A1"). A1 was analyzed by an inductively coupled plasma spectrometer (ICP) and was determined to have the following composition: $(Zr_{55}Al_{10}Cu_{30}Ni_5)_{97}(Y_2O_3)_3$,

Comparative Example 1

A first comparative alloy was prepared in accordance with Example 1, except that the first mixture had a composition of $Zr_{55}Al_{10}Cu_{30}Ni_5$. The first comparative alloy ingot ("B1") was analyzed by an inductively coupled plasma spectrometer (ICP) and was determined to have the following composition: $Zr_{55}Al_{10}Cu_{30}Ni_5$.

Example 2

A second exemplary alloy was prepared as follows:

a) Zr, Ti, Cu, Ni, Be, and $Y_2O_3$, according to a molar ratio for $Zr_{41}Ti_{14}Cu_{12.5}Ni_{10}Be_{22.5}$:$Y_2O_3$:Zr of about 98:3.5:1.5, were mixed to form a first mixture, in which Al, Cu, Ni and Be were all high purity metals, Zr was zirconium sponge commercially available from Baoti Huashen Titanium Industry Co., Ltd., located in Jinzhou, P.R.C., and $Y_2O_3$ was a metal oxide. The first mixture was added to a melting chamber with a nominal capacity of about 25 Kg in a ZG-03 medium frequency vacuum induction melting furnace commercially available from Sante Vacuum Metallurgy Technology Industry Co., Ltd., located in Jinzhou, P.R.C. The melting chamber was vacuumized to a vacuum degree of about 5 Pa, and then argon was filled in the melting chamber until the vacuum degree reached about 40 kPa. The first mixture was completely melted at a power of about 25 kW to form a molten mixture.

b) The molten mixture was kept at a temperature of about 1050° C. (about 300° C. above the melting temperature of the alloy) for about 5 minutes, then was allowed to stand at room temperature for about 3 minutes.

c) When the temperature of the molten mixture dropped to about 830° C. (about 80° C. above the melting temperature of the alloy), the molten mixture was filtered by a pouring cup having a steel wire mesh with a diameter of about 1 millimeters, cast in a mold, then cooled to room temperature under argon to form a second alloy ingot ("A2"). A2 was analyzed by an inductively coupled plasma spectrometer (ICP) and was determined to have the following composition: $(Zr_{41}Ti_{14}Cu_{12.5}Ni_{10}Be_{22.5})_9O_2O_3)_2$.

Comparative Example 2

A second comparative alloy was prepared in accordance with Example 2, except that the first mixture had a composition of: $Zr_{41}Ti_{14}Cu_{12.5}Ni_{10}Be_{22.5}$. The second comparative alloy ingot ("B2") was analyzed by an inductively coupled plasma spectrometer (ICP) and was determined to have the following composition: $Zr_{41}Ti_{14}Cu_{12.5}Ni_{10}Be_{22.5}$.

Example 3

A third exemplary alloy was prepared as follows:

a) Zr, Al, Cu, Ni, and MgO, according to a molar ratio for $Zr_{63.5}Al_{3.6}Cu_{26}Ni_{6.9}$:MgO:Zr of about 96:4.8:0.8, were mixed to form a first mixture, in which Al, Cu and Ni were all high purity metals, Zr was zirconium sponge commercially available from Baoti Huashen Titanium Industry Co., Ltd., located in Jinzhou, P.R.C., and $Y_2O_3$ was a metal oxide. The first mixture was added to a melting chamber with a nominal capacity of about 25 Kg in a ZG-03 medium frequency vacuum induction melting furnace commercially available from Sante Vacuum Metallurgy Technology Industry Co., Ltd., located in Jinzhou, P.R.C. The melting chamber was vacuumized to a vacuum degree of about 1.5 Pa, and then argon was filled in the melting chamber until the vacuum degree reached about 40 kPa. The first mixture was completely melted at a power of about 25 kW to form a molten mixture.

b) The molten mixture was kept at a temperature of about 950° C. (about 100° C. above the melting temperature of the alloy) for about 5 minutes, and then was allowed to stand at room temperature for about 3 minutes.

c) When the temperature of the molten mixture dropped to about 920° C. (about 70° C. above the melting temperature of the alloy), the molten mixture was filtered by a pouring cup having a Mo wire mesh with a diameter of about 0.8 millimeters, cast in a mold, then cooled to room temperature under argon to form a third alloy ingot ("A3"). A3 was analyzed by an inductively coupled plasma spectrometer (ICP) and was determined to have the following composition: $(Zr_{63.5}Al_{3.6}Cu_{26}Ni_{6.9})_{96}(MgO)_4$.

Comparative Example 3

A third comparative alloy was prepared in accordance with Example 3, except that the first mixture consisted of Zr, Al, Cu, Ni and Ca, according to a molar ratio for $Zr_{63.5}Al_{3.6}Cu_{26}Ni_{6.9}$:Ca, of about 96:4. The third comparative alloy ingot ("B3") was analyzed by an inductively coupled plasma spectrometer (ICP) and was determined to have the following composition: $(Zr_{63.5}Al_{3.6}Cu_{26}Ni_{6.9})_{96}Ca_4$.

Example 4

A fourth exemplary alloy was prepared as follows:

a) Zr, Ti, Cu, Ni, Be, MgO, and CaO, according to a molar ratio of $Zr_{62.4}Ti_{11.2}Cu_{13.3}Ni_{9.8}Be_{3.3}$:$(MgO)_{50}(CaO)_{50}$:Zr of about 96:6:2, were mixed to form a first mixture, in which Al, Cu and Ni were all high purity metals, Zr was zirconium sponge commercially available from Baoti Huashen Titanium Industry Co., Ltd., located in Jinzhou, P.R.C., and $Y_2O_3$ was a metal oxide. The first mixture was added to a melting chamber with a nominal capacity of about 25 Kg in a ZG-03 medium frequency vacuum induction melting furnace commercially available from Sante Vacuum Metallurgy Technology Industry Co., Ltd, located in Jinzhou, P.R.C. The melting chamber was vacuumized to a vacuum degree of about 4 Pa, and then argon was filled in the melting chamber until the vacuum degree reached about 40 kPa. The mixture was completely melted at a power of about 25 kW to form a molten mixture.

b) The molten mixture was kept at a temperature of about 1050° C. (about 300° C. above the melting temperature of the alloy) for about 5 minutes, then was allowed to stand at room temperature for about 3 minutes.

c) When the temperature of the molten mixture dropped to about 830° C. (about 80° C. above the melting temperature of the alloy), the molten mixture was filtered by a pouring cup having a steel wire mesh with a diameter of about 1 millimeter, cast in a mold, then cooled to room temperature under argon to form a fourth alloy ingot ("A4"). A4 was analyzed by an inductively coupled plasma spectrometer (ICP) and was determined to have the following composition: $(Zr_{62.4}Ti_{11.2}Cu_{13.3}Ni_{9.8}Be_{3.3})_{96}((MgO)_{50}(CaO)_{50})_4$.

Example 5

A fifth exemplary alloy was prepared as follows:

a) A scrap alloy represented by the formula of $Zr_{63.5}Al_{3.6}Cu_{26}Ni_{5.9}Y_1$ was jaw crushed into bulk wastes with an average individual size of about 3 centimeters to about 5 centimeters. About 5 kilograms of bulk waste was weighed, and subjected to a de-rusting treatment, a surface oxide removal treatment, and the a de-greasing treatment.

b) The bulk waste was analyzed by an IRO-II type oxygen content analyzer and determined to have an oxygen content of about 1085 parts per million, or about 0.1085 wt %, based on the weight of the bulk waste. The bulk waste was mixed with about 19.15 g (i.e. $W_2$=3.53 A) of $Y_2O_3$ and about 30.87 g (i.e. $W_1$=5.69 A) of Zr to form a first mixture. The first mixture was added to a melting chamber with a nominal capacity of about 25 Kg in a ZG-03 medium frequency vacuum induction melting furnace commercially available from Sante Vacuum Metallurgy Technology Industry Co., Ltd, located in Jinzhou, P.R.C. The melting chamber was vacuumized to a vacuum degree of about 0.08 Pa, and then argon was filled in the melting chamber until the vacuum degree reached about 40 kPa. The first mixture was completely melted at a power of about 25 kW to form a molten mixture.

c) The molten mixture was kept at a temperature of about 1050° C. (about 200° C. above the melting temperature of the alloy) for about 5 minutes, then was allowed to stand at room temperature for about 3 minutes.

d) When the temperature of the molten mixture dropped to about 920° C. (about 70° C. above the melting temperature of the alloy), the molten mixture was filtered by a pouring cup having a Mo wire mesh with a diameter of about 0.8 millimeters, cast in a mold, then cooled to room temperature under argon to form a first exemplary recycling alloy ingot ("S1").

Comparative Example 5A

A first recycling comparative alloy was prepared in accordance with Example 5, except that the bulk waste was not mixed with $Y_2O_3$ and Zr. Instead, the bulk waste was melted directly to form a first comparative recycling alloy ingot ("D5A").

Comparative Example 5B

A second recycling comparative alloy was prepared in accordance with Example 5, except that the bulk waste was mixed with about 20 g of Y to form a first mixture, and the first mixture was melted to form a second comparative recycling alloy ingot ("D5B").

Comparative Example 5C

A third recycling comparative alloy was prepared in accordance with Example 5, except that the bulk waste was mixed with about 20 g of $Y_2O_3$ to form a first mixture, and the first mixture was melted to form a third comparative recycling alloy ingot ("D5C").

Example 6

A sixth exemplary alloy was prepared as follows:

a) A scrap alloy represented by the formula of $Zr_{62.4}Ti_{11.2}Cu_{13.3}Ni_{9.8}Be_{3.3}$ was jaw crushed into bulk wastes with an average individual size of about 3 centimeters to about 5 centimeters. About 5 kilograms of bulk waste was weighed, and subjected to a de-rusting treatment, a surface oxide removal treatment, and the a de-greasing treatment.

b) The bulk waste was analyzed by an IRO-II type oxygen content analyzer and determined to have an oxygen content of about 2013 parts per million, or about 0.2013 wt %, based on the weight of the bulk waste. The bulk waste was mixed with about 37.12 g (i.e. $W_2$=3.53 A) of $Y_2O_3$ and about 59.83 g (i.e. $W_1$=5.69 A) of Zr to form a first mixture. The first mixture was added to a melting chamber with a nominal capacity of about 25 Kg in a ZG-03 medium frequency vacuum induction melting furnace commercially available from Sante Vacuum Metallurgy Technology Industry Co., Ltd., located in Jinzhou, P.R.C. The melting chamber was vacuumized, and then argon was filled in the melting chamber until the vacuum degree reached about 0.08 kPa. The mixture was completely melted at a power of about 25 kW to form a molten mixture.

c) The molten mixture was kept at a temperature of about 1050° C. (about 300° C. above the melting temperature of the alloy) for about 5 minutes, then was allowed to stand at room temperature for about 3 minutes.

d) When the temperature of the molten mixture dropped to about 830° C. (about 80° C. above the melting temperature of the alloy), the molten mixture was filtered by a pouring cup having a steel wire mesh with a diameter of about 1 millimeter, cast in a mold, then cooled to room temperature under argon to form a second exemplary recycling alloy ingot ("S2").

Comparative Example 6A

A fourth recycling comparative alloy was prepared in accordance with Example 6, except that the bulk waste was not mixed with $Y_2O_3$ and Zr. Instead, the bulk waste was melted directly to form a fourth comparative recycling alloy ingot ("D6A").

Comparative Example 6B

A fifth recycling comparative alloy was prepared in accordance with Example 6, except that the bulk waste was mixed with about 20 g of Y to form a first mixture, and the first mixture was melted to form a fifth comparative recycling alloy ingot ("D6B").

Comparative Example 6C

A sixth recycling comparative alloy was prepared in accordance with Example 6, except that the bulk waste was mixed with about 20 g of $Y_2O_3$ to form a first mixture, and the first mixture was melted to form a sixth comparative recycling alloy ingot ("D6C").

Example 7

A seventh exemplary alloy was prepared as follows:

a) About 5 Kg of bulk waste according to Example 6, with an oxygen content of about 2103 parts per million (i.e. A=0.2103), was mixed with about 31.86 g (i.e. $W_2$=3.03 A) of $Y_2O_3$ and about 72.45 g (i.e. $W_1$=6.89 A) of Zr to form a first mixture. The first mixture was added to a melting chamber with a nominal capacity of about 25 Kg in a ZG-03 medium frequency vacuum induction melting furnace commercially available from Sante Vacuum Metallurgy Technology Industry Co., Ltd., located in Jinzhou, P.R.C. The melting chamber was vacuumized, and then argon was filled in the melting chamber until the vacuum degree reached about 0.08 kPa. The mixture was completely melted at a power of about 25 kW to form a molten mixture.

b) The molten mixture was kept at a temperature of about 1050° C. (about 300° C. above the melting temperature of the alloy) for about 5 minutes, then was allowed to stand at room temperature for about 3 minutes.

c) When the temperature of the molten mixture dropped to about 830° C. (about 80° C. above the melting temperature of the alloy), the molten mixture was filtered by a pouring cup having a steel wire mesh with a diameter of about 1 millimeter, cast in a mold, then cooled to room temperature under argon to form a third exemplary recycling alloy ingot ("S3").

Testing

1) Bending Strength

Each of the alloy ingots A1-4 and B1-3 were cast in an arc furnace to form a sheet with a size of about 3 millimeters×6 millimeters×15 millimeters. The bending strength of each sheet was tested by a CMT5105 microcomputer control electronic universal testing machine with a tonnage of about 1000 kilograms commercially available from Shenzhen Sans Testing Machine Co., Ltd., located in P.R.C. according to the GB/T14452-93 method under the conditions of a span of about 50 millimeters and a loading speed of about 0.5 millimeters/minute. The results are illustrated in Table 1. The stress-strain curve of each of the alloy ingots A1-4 and B1-3 was obtained accordingly and are illustrated in FIG. 1. The maximum plastic strain of each of the alloy ingots A1-4 and B1-3 was calculated, and are illustrated in Table 1.

The bending strength of the alloy ingots S1-3, D5A-C and D6A-C were tested by the method described above respectively. The results are illustrated in Table 2.

2) Impact Toughness

Each of the alloy ingots A1-4 and B1-3 were cast in an arc furnace to form a sheet with a size of about 3 millimeters×6 millimeters×15 millimeters. The impact toughness of each sheet was tested by a ZBC1251-2 pendulum impact tester commercially available from Shenzhen Sans Testing Machine Co., Ltd., located in P.R.C. The results are illustrated in Table 1.

The impact toughness of the Zr-based alloy ingots S1-3, D5A-C and D6A-C were each tested by the method described above. The results are illustrated in Table 2.

3) X-Ray Diffraction (XRD)

Figure 2:
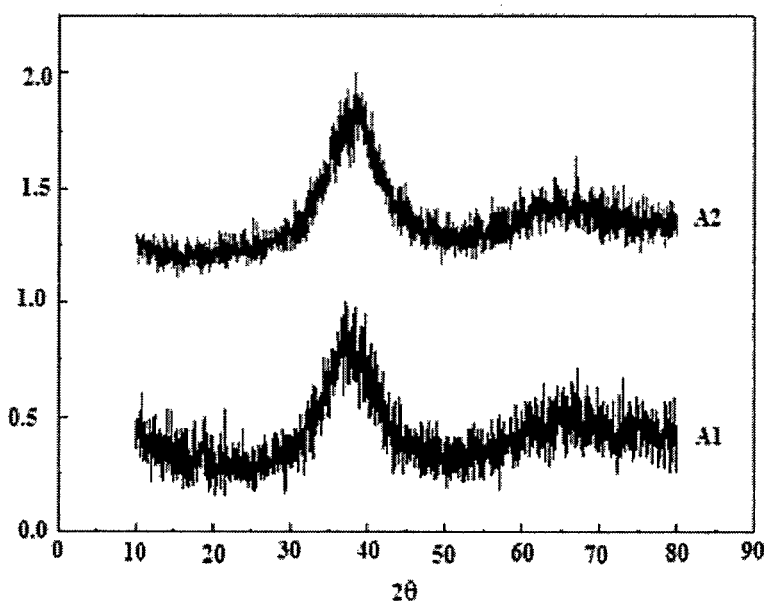
FIG. 2 illustrates an X-ray diffraction pattern of exemplary alloys of the present disclosure.

The alloy ingots A1-4 and B1-3 were tested by D-MAX2200PC X-ray powder diffractometer under the conditions of a copper target, an incident wavelength of about 1.54060 Å, an accelerating voltage of about 40 KV, a current of about 20 mA, and a scanning step of about 0.04°. The diffraction patterns of the alloy ingots A1-4 and B1-3 are illustrated in FIG. 2.

The alloy ingots S1-3, D51-53 and D64-66 were each tested by the method described above. The results are illustrated in FIG. 2.

4) Oxygen Content

The alloy ingots S1-3, D51-53 and D64-66 were each tested by an IRO-II oxygen content analyzer commercially available from Beijing NCS Analytical Instruments Co., Ltd. The results are illustrated in Table 2.

TABLE 1

| No. | Bending Strength (MPa) | Maximum Plastic Strain (%) | Impact Toughness (KJ/m$^2$) |
|---|---|---|---|
| A1 | 2780 | 4.1 | 110 |
| A2 | 2676 | 3.3 | 98 |
| A3 | 2533 | 3.6 | 88 |
| A4 | 2574 | 3.9 | 91 |
| B1 | 2133 | 2.3 | 66 |
| B2 | 2311 | 1.8 | 71 |
| B3 | 2405 | 2.6 | 80 |

TABLE 2

| No. | Oxygen Content (PPM) | Bending Strength (MPa) | Impact Toughness (KJ/m$^2$) |
|---|---|---|---|
| S1 | 420 | 2648 | 66 |
| D5A | 1180 | 2034 | 40 |
| D5B | 800 | 1818 | 51 |
| D5C | 520 | 2558 | 60 |
| S2 | 1705 | 2910 | 61 |
| D6A | 2103 | 2130 | 42 |
| D6B | 1950 | 1890 | 39 |
| D6C | 1745 | 2810 | 55 |
| S3 | 1660 | 2880 | 59 |

Although explanatory embodiments have been shown and described, it would be appreciated by those skilled in the art that changes, alternatives, and modifications can be made in the embodiments without departing from spirit and principles of the disclosure. Such changes, alternatives, and modifications all fall into the scope of the claims and their equivalents.

What is claimed is:

1. A method of preparing an alloy comprising:

mixing at least the following raw materials: Zr, M, N and Q according to a molar ratio of $Zr_aM_bN_c$:Q:Zr of about (100−x):(x+y):y to form a first mixture;

melting the first mixture to form a molten mixture;

filtering, casting and cooling the molten mixture to form the alloy represented by the general formula of $(Zr_aM_bN_c)_{100-x}Q_x$, wherein: M is at least one transition metal of the periodic table of the elements other than Zr; N is Be or Al; Q is selected from the group consisting of CaO, MgO, $Nd_2O_3$, and combinations thereof; a, b, and c are atomic percents of corresponding elements; and 45≤a≤75, 20≤b≤40, 1≤c≤25, a+b+c=100, 1≤x≤15, and 0.1≤y≤5.

2. The method of claim 1, wherein M is at least two metals selected from the group consisting of: Ti, Ni and Cu.

3. The method of claim 1, wherein 50≤a≤70, 25≤b≤35, 3≤c≤23, 2≤x≤5, and 0.2≤y≤2.

4. The method of claim 1, wherein the melting step is performed in a melting furnace having a melting chamber; and the melting chamber is vacuumized to a vacuum degree of from about 0.1 Pa to about 10 Pa, at a temperature of about 100° C. above the melting temperature of the alloy, further including the step of:

filling inert gas in the melting chamber until the vacuum degree reaches from about 30 kPa to about 50 kPa.

5. The method of claim 4, wherein the melting chamber is vacuumized to a vacuum degree of from about 0.5 Pa to about 5 Pa, at a temperature of from about 100° C. to about 300° C. above the melting temperature of the alloy, further including the step of filling an inert gas in the melting chamber until the vacuum degree reaches from about 35 kPa to about 45 kPa.

6. The method of claim 1, wherein the molten mixture is filtered through a high temperature resistant mesh having a mesh diameter ranging from about 0.5 millimeters to about 5 millimeters.

7. The method of claim 1, wherein the casting step is performed at a temperature of about 30° C. to about 80° C. above the melting temperature of the alloy under an inert gas.

8. A method of recycling a waste alloy comprising:

mixing a waste alloy with an additive to form a mixture, wherein the additive is a mixture of Zr and a metal oxide, and the metal oxide is selected from the group consisting of CaO, MgO, $Nd_2O_3$, and combinations thereof;

melting the mixture under a vacuum to form a molten mixture;

filtering, casting and cooling the molten mixture under an inert gas to form an alloy.

9. The method of claim 8, wherein relative to 100 parts by weight of the waste alloy, the amount of Zr and metal oxide are represented by: $W_1$=(0.5~12)×A, and $W_2$=(0.5~7)×A, wherein $W_1$ is Zr in parts by weight, $W_2$ is metal oxide in parts by weight, and A is the weight percent of oxygen in the waste alloy.

10. The method of claim 9, wherein $W_1$=(5-7)×A, and $W_2$=(3-4)×A.

11. The method of claim 10, wherein by weight relative to 100 parts by weight of the waste alloy, the total amount of Zr and the metal oxide in parts by weight is represented by: $W_3$=(8.5~11)×A.

12. The method of claim 8, wherein the melting step is performed in conditions of: a vacuum degree ranging from about 0.05 Pa to about 5 Pa and a temperature of about 200° C. to about 500° C. above the melting temperature of the alloy, and for a time ranging from about 2 minutes to about 10 minutes.

13. The method of claim 8, wherein the molten mixture is filtered through a high temperature resistant mesh having a mesh diameter of from about 0.5 millimeters to about 10 millimeters, wherein the high temperature resistant mesh is selected from the group consisting of: steel wire mesh, ceramic mesh, Mo wire mesh and fiber mesh.

14. The method of claim 8, wherein the casting step is performed at a temperature ranging from about 50° C. to about 150° C. above the melting temperature of the alloy.

15. The method of claim 8, wherein the inert gas is selected from the group consisting of helium, neon, argon, krypton, xenon, radon, and combinations thereof.

16. The method of claim 8, wherein the alloy is represented by the formula of $Zr_aM_bN_cY_d$, in which M is at least one transition metal;

N is Be or Al; and a, b, c and d are atomic percents of corresponding elements, in which 45≤a≤65, 20≤b≤40, 1≤c≤25, and 0≤d≤5.

17. The method of claim 8, wherein the molten mixture is allowed to stand for about 1 minute to about 10 minutes prior to the filtering step.

* * * * *